United States Patent [19]

Parsons

[11] Patent Number: 4,809,893

[45] Date of Patent: Mar. 7, 1989

[54] RUCKSACK WITH INTERMEDIATE OPENING

[75] Inventor: Michael C. Parsons, Rossendale, England

[73] Assignee: Karrimor International Limited, Lancashire, England

[21] Appl. No.: 77,374

[22] Filed: Jul. 24, 1987

[30] Foreign Application Priority Data

Aug. 11, 1986 [EP] European Pat. Off. ..... 86306181.8

[51] Int. Cl.[4] ..... A45E 3/08

[52] U.S. Cl. ..... 224/210; 224/261

[58] Field of Search ..... 224/209–216, 224/259–263

[56] References Cited

U.S. PATENT DOCUMENTS

| | | | |
|---|---|---|---|
| 2,517,757 | 8/1950 | Adlerstein | 224/210 X |
| 3,321,120 | 5/1967 | Cunningham | 224/209 |
| 3,622,056 | 11/1971 | Droeger | 224/209 X |
| 3,889,859 | 6/1975 | Joseph . | |
| 4,068,314 | 1/1978 | Yellen et al. | 224/209 X |
| 4,356,942 | 11/1982 | Hayes | 224/211 |
| 4,420,103 | 12/1983 | Douglass | 224/209 X |

FOREIGN PATENT DOCUMENTS

| | | | |
|---|---|---|---|
| 845099 | 7/1949 | Fed. Rep. of Germany . | |
| 7619523 | 6/1976 | Fed. Rep. of Germany . | |
| 813280 | 1/1936 | France . | |
| 1032292 | 2/1951 | France . | |
| 53574 | 2/1934 | Norway | 224/209 |
| 66723 | 9/1943 | Norway | 224/209 |
| 227720 | 6/1943 | Switzerland | 224/209 |
| 323451 | 1/1930 | United Kingdom | 224/209 |

*Primary Examiner*—Henry J. Recla
*Assistant Examiner*—Robert Petrik
*Attorney, Agent, or Firm*—Cohn, Powell & Hind

[57] ABSTRACT

A fabric sack, comprising top, bottom, front and rear walls, has an opening for access to its interior provided in an inclined upper region of its front wall to avoid interference by any luggage strapped to the top wall of the sack and also to allow easy access when the sack is upright and/or on someone's back, and/or laid down on its rear wall. An internal supporting frame extending up the rear wall and across the top of the sack is also provided.

10 Claims, 3 Drawing Sheets

RUCKSACK WITH INTERMEDIATE OPENING

TECHNICAL FIELD

This invention relates to a rucksack comprising a fabric sack which is supported by a substantially rigid frame so as to have top and bottom and front and rear walls, the fabric sack also having shoulder straps and a hip belt attached to its rear as well as an opening giving access to its interior and a flap which covers said opening.

PRIOR ART

FIGS. 1 and 2 are diagrammatic perspectivie views of two previously known types of rucksack.

A conventional rucksack, as shown in FIG. 1 has an external frame (not shown) in the form of a generally rectangular structure attached to the rear wall of a fabric sack 108 and an access opening 20 in the top of the sack 10. A flap 30 which covers the opening 20 when access is not required is attached at the junction of the rear wall and the top wall of the sack 10 and can be secured to the front of the sack by straps 31 engaging buckles 32. The disadvantages of this traditional rucksack design are, firstly, that access via the opening 20 is difficult when the rucksack is on someone's back since the opening 20 is then too high for most companions to reach into; secondly, that access to items stowed at the bottom of the sack 10 is difficult in any case; and, thirdly, that access is frequently made more difficult by the presence of additional luggage, such as a bedding roll, strapped to the top of the rucksack directly on top of the flap 30.

A less common, alternative type of rucksack, as shown in FIG. 2, has frontal access via a large flap 33 which extends over most of the front of the sack 10 and is closed by a zip fastener 34. This design avoids the latter two disadvantages of the conventional top access rucksack (FIG. 1). However, it cannot conveniently be opened when standing upright (as shown) or when on someone's back as that would cause all the contents of the sack 10 to fall out, and it must therefore be taken off and laid rear downwards before it can be opened. Clearly this is rather inconvenient for the user. Moreover, with such an arrangement it is not usually possible to provide pockets on the front of the rucksack in view of the presence of the large opening flap 33.

OBJECT OF THE INVENTION

It is an object of the present invention to provide a novel rucksack construction which will overcome the disadvantages of previously known rucksacks, as outlined above, with regard to the opening of same for access to the interior.

SUMMARY OF THE INVENTION

This object is achieved in accordance with the invention in that the opening to the interior of the sack is located in an inclined upper region of the front wall of the sack.

This enables access to the interior of the sack either from above or from the frontal direction (or any angle therebetween) without interference from any luggage strapped to the top of the sack. Moreover, access to items at the bottom of the sack and access whilst mounted on someone's back is facilitated due to the possibility of frontal entry to the interior at a lower position than with the conventional top opening rucksack design, yet without the danger of all the contents spilling out.

The upper regions of both the front and rear walls of the sack are advantageously inclined rearwardly with respect to the remainder of the sack, since such curvature of the rear wall enables it to fit snugly against a user's back.

The flap which covers the access opening is advantageously connected to the sack at the junction between the top wall and the front wall of the fabric sack so as to close downwardly over the access opening. This is preferable to an upwardly closing flap since the possibility of interference with any top-mounted load, e.g. by straps and buckles etc. used for effecting closure of the flap, is completely avoided.

In a preferred development of the invention an internal supporting frame is provided in the form of sheet material which extends the length of the rear wall and across the top wall of the fabric sack. The provision of the frame in the form of sheet material prevents outward protrusion of any part of a load located inside the fabric sack, as sometimes occurs where the frame consists of spaced apart frame members, and this ensures the comfort of the user. Moreover the extension of the supporting frame across the top of the sack enables the covering flap for the opening to be secured to the sack along a well-supported junction.

BRIEF DESCRIPTION OF THE DRAWINGS

Preferably the frame consists of a single, bent sheet of corrugated polypropylene reinforced by metal rods or metal wire.

The invention will be described further, by way of example, with reference to the remaining drawings, in which.

DETAILED DESCRIPTION OF THE ILLUSTRATED EMBODIMENT

Figure 3:
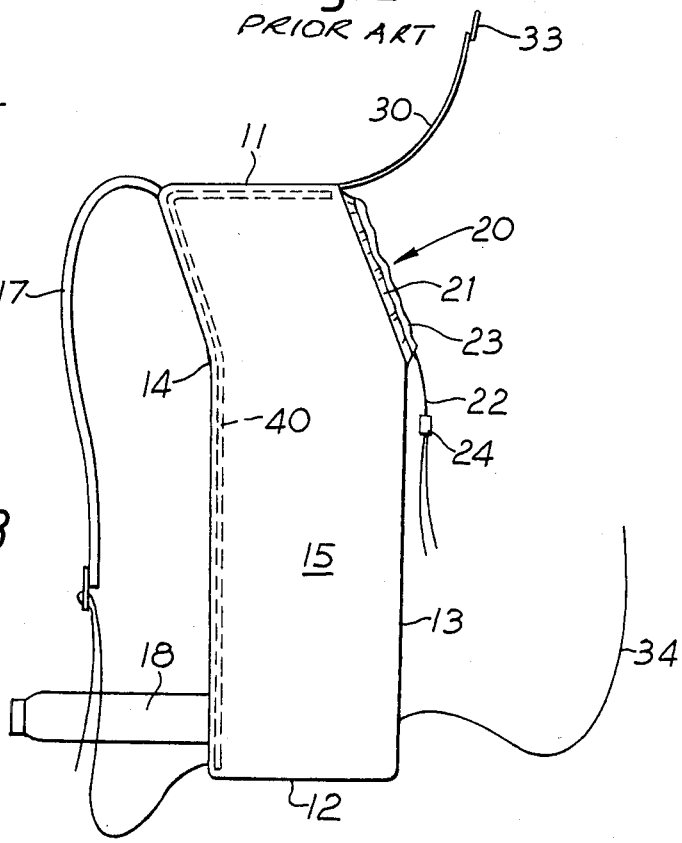
FIG. 3 is a schematic side view of a preferred embodiment of the rucksack of the invention.
Figure 4:
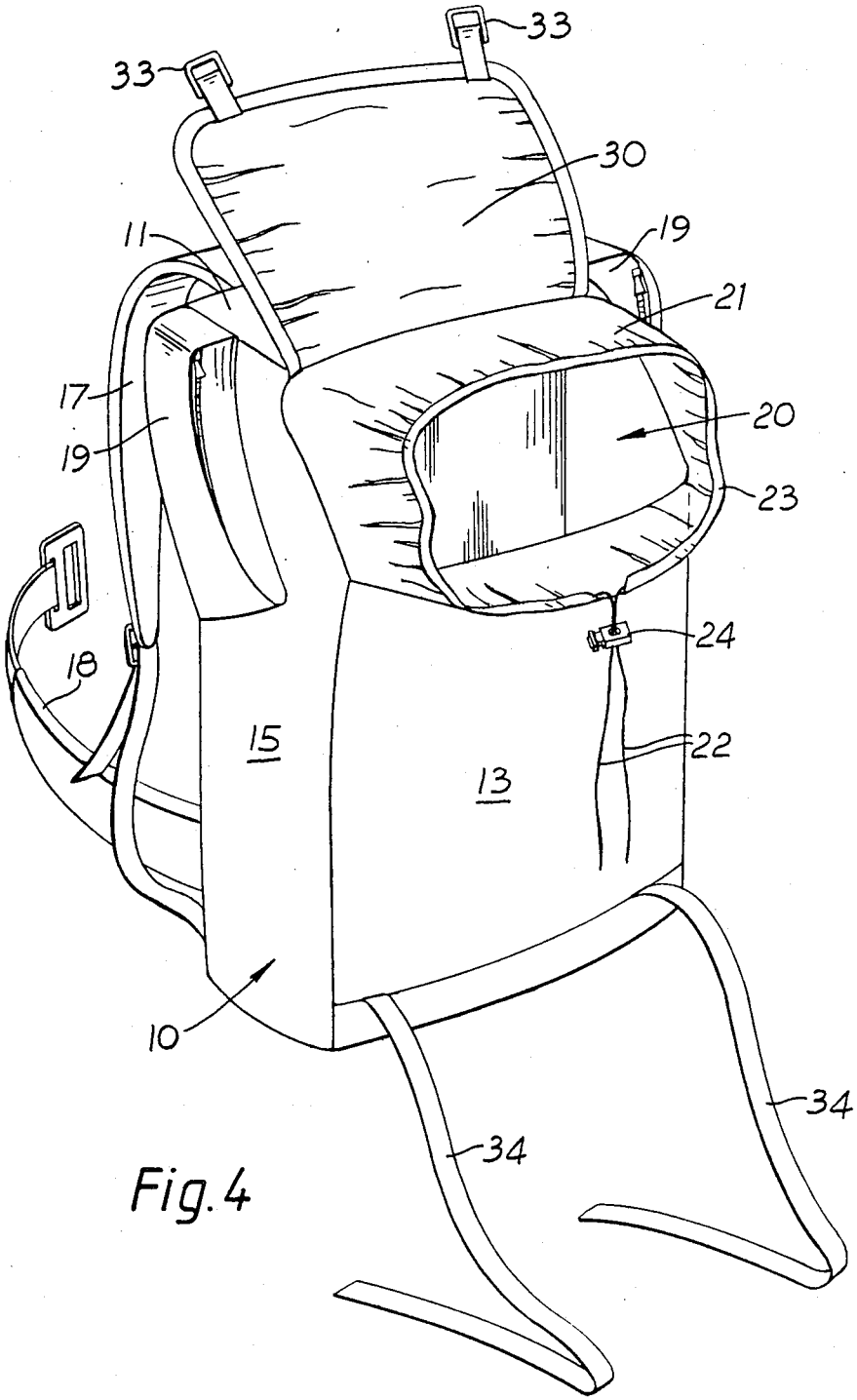
FIG. 4 is an enlarged, more detailed perspective view of the preferred embodiment shown in FIG. 3.

As shown in FIGS. 3 and 4, a preferred embodiment of the rucksack of the invention comprises a fabric sack 10 supported by a substantially rigid internal frame 40 so as to have top and bottom walls 11, 12, front and rear walls 13, 14 and respective side walls 15. Shoulder straps 17 are attached to the sack 10 between the junction between the top and rear walls 11, 14 and the lower part of the rear wall 14, and a hip belt 18 is similarly attached to the sack 10 in the lower region of the rear wall 14. Pockets 19 may be provided on the side walls 15, as shown in FIG. 4.

The upper region of both the front and rear walls 13, 14 are inclined rearwardly with respect to the remainder of the sack, as most clearly indicated in FIG. 3. In the case of the rear wall 14, this inclination of the upper region enables it to fit more closely onto a user's back, whilst the inclined upper region of the front wall 13 is the location of an opening 20 permitting access to the interior of the sack 10. The opening 20 is defined by a broad, encircling fabric edging strip 21, almost in the nature of a frill, which can be gathered to reduce the size of the opening 20 by means of a draw cord 22. This cord 22 extends through a tunnel 23 formed around the periphery of the strip 21 and has free ends which hang from the lowest point of the strip 21, and extend through a small clamping device 24. In the illustrated embodiment, the entire inclined upper region of the sack front wall 13 is constituted by this encircling strip 21.

A flap 30 which serves to cover the opening 20 when access to the sack interior is not actively sought, is connected to the sack 10 along the junction of the top wall 11 and the inclined upper region of the front wall 13. The flap 30 thus swings downwardly to overlie the opening 20, including the surrounding strip 21, and it carries a pair of buckles 33 which can be fastened to respective straps 34 attached near the bottom of the front wall 13 to securely close off the opening 20. The flap 30 is, in fact, sufficiently large to cover the entire inclined upper region of the front wall 13 as well as part of the lower region of the front wall, when it is swung down to its closed position.

Figure 1:
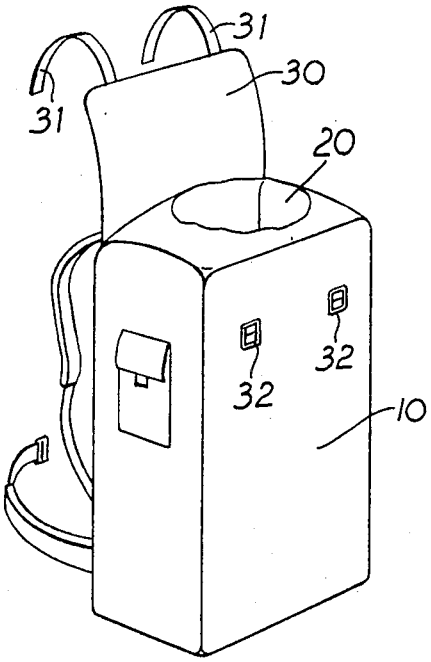
Fig. 1 PRIOR ART
FIGS. 1 and 2 are diagrammatic perspective views of two previously known types of rucksack.
Figure 2:
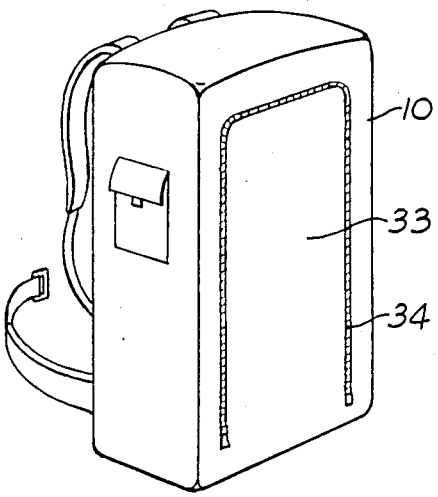
Fig. 2 PRIOR ART

The positioning of the access opening 20, as just described, is more convenient than having an opening in the top wall 11 or over an entire upright front wall, as in the prior art (see FIGS. 1 and 2) since luggage can be strapped to the top of the sack 10 without interfering in any way with access to the interior of the sack, whilst, at the same time, access to the interior can be obtained while the sack is in an upright position and/or mounted on a person's back. Of course, convenient frontal access to the sack is still possible when the sack is laid down upon its rear wall.

Figure 5:
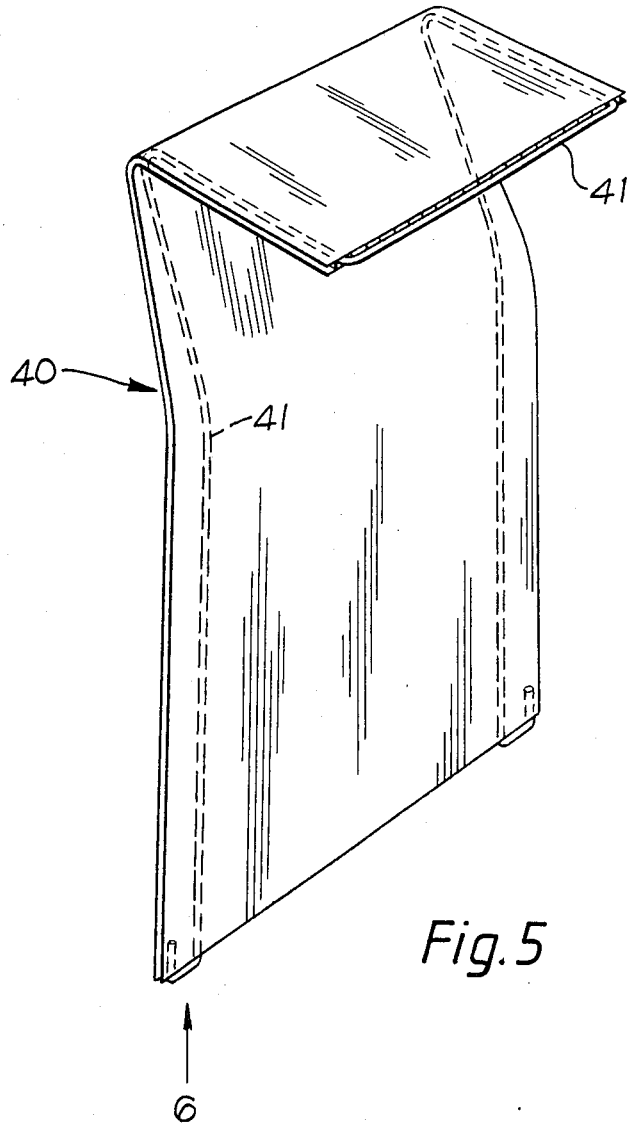
FIG. 5 is a perspective view of the internal frame of the rucksack shown in FIGS. 3 and 4.
Figure 6:
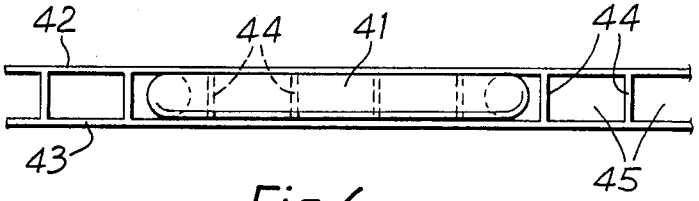
FIG. 6 is a fragmentary end view of the frame of FIG. 5 in the direction indicated by the arrow 6 in FIG. 5.

With reference to FIGS. 5 and 6, the internal supporting frame 40 of the rucksack consists of a single sheet of corrugated polypropylene reinforced by a length of thick metal wire 41. The sheet extends the length of the rear wall 14 of the sack 10, being appropriately rearwardly bent in the upper region thereof, and it is then further bent at an acute angle (beneath the junction between the rear wall 14 and the top wall 11) so as to extend right across beneath the top wall 11 to its junction with the front wall 13. Provision of a frame in the form of a sheet, rather than in the form of separate frame members of an open structure of some sort, as hitherto, prevents any parts of the contents of the sack 10 poking through the frame into the back of a wearer. Moreover, extension of the frame across the top of the sack provides a frim support for any luggage which is to be strapped to the top of the sack and for the top wall/-front wall junction along which the cover flap 30 is attached.

The corrugated polypropylene comprises spaced apart skins or membranes 42, 43 connected at regular intervals by a series of perpendicular cross walls 44, as indicated in FIG. 6, so as to provide a series of parallel channels 45. The metal wire 41, which serves as a reinforcement, is inserted through appropriately chosen channels 45 adjacent the side edges of the sheet and extends the entire length of the sheet, at each side, as well as across the front edge at the top. The two end positions of the wire 41 are also bent over outwardly to form respective U-shaped configurations so that the extreme tips of the wire can be inserted into the ends of other channels 45 at the bottom of the sheet, as indicated in FIG. 5.

The invention is not limited to the exact details of the foregoing example. For example, an access opening in an inclined upper region of the front wall of the sack may be provided in a rucksack having a more conventional external frame in the form of a pair of upright frame members connected together by transverse elements. Also the opening need not necessarily take up the entire upper inclined region of the front, but merely a part thereof. Moreover, where an internal frame is provided it does not necessarily have to extend across the top of the sack or be formed by a single sheet, although both these features are preferred. Many other minor variations are also possible, such as reinforcement of a sheet material frame by a plurality of separate metal rods and in a different manner to that in the specifically described embodiment.

I claim:

1. A rucksack comprising:

a fabric sack;

a substantially rigid frame supporting said sack so as to have a top wall, a bottom wall, a front wall and a rear wall;

said frame comprising sheet material extending the length of said rear wall and across said top wall of said fabric sack;

shoulder straps and a hip belt attached to said rear wall of said sack;

said front wall having a rearwardly inclined upper region, said upper region including means for defining an opening giving access to the interior of said sack; and a flap attached to said sack to cover said opening.

2. A rucksack as set forth in claim 1 wherein said rear wall also has a rearwardly inclined upper region.

3. A rucksack as set forth in claim 1 wherein a junction is defined between said top wall and said front wall and said flap is attached to said sack at said junction.

4. A rucksack as set forth in claim 1 wherein said substantially rigid frame means is arranged internally of said fabric sack.

5. A rucksack as set forth in claim 1 wherein said frame comprises a single sheet of plastics bent at an angle between said rear wall and said top wall.

6. A rucksack as set forth in claim 5 wherein said plastic sheet has metal means for reinforcing said plastics sheet.

7. A rucksack comprising:

a fabric sack having a top panel, a bottom panel, a front panel and a rear panel;

the rear panel having shoulder straps attached thereto; the sack having means for defining an opening giving access to the inside of said sack;

a flap attached to said sack to cover said opening; a frame located inside said sack to support said sack; the frame being of a substantially rigid sheet material; and said frame extending the length of said rear panel and at least partially across said top panel.

8. A rucksack as set forth in claim 7 wherein said front panel has an upper region inclined towards the rear panel and said opening is disposed in this region.

9. A rucksack as set forth in claim 7 wherein said frame comprises a sheet of two spaced membranes of plastic material with joining plastics cross walls therebetween at spaced intervals, said sheet being reinforced by a metal wire inserted between said cross walls.

10. A rucksack as set forth in claim 5, wherein said plastics sheet comprises two spaced apart membranes of plastics material joined at intervals by plastics cross walls extending therebetween.

* * * * *